US008091706B2

(12) United States Patent
Koefelda

(10) Patent No.: US 8,091,706 B2
(45) Date of Patent: Jan. 10, 2012

(54) CONTAINER

(75) Inventor: Gerald R. Koefelda, Sunningdale (GB)

(73) Assignee: Rehrig Pacific Company, Los Angeles, CA (US)

( * ) Notice: Subject to any disclaimer, the term of this patent is extended or adjusted under 35 U.S.C. 154(b) by 204 days.

(21) Appl. No.: 12/545,927

(22) Filed: Aug. 24, 2009

(65) Prior Publication Data

US 2010/0044371 A1 Feb. 25, 2010

Related U.S. Application Data

(60) Provisional application No. 61/091,506, filed on Aug. 25, 2008.

(51) Int. Cl.
*B65D 21/00* (2006.01)
*B65D 85/62* (2006.01)

(52) U.S. Cl. ..... 206/506; 220/6

(58) Field of Classification Search ..... 220/4.28, 220/6, 7, 756; 206/506
See application file for complete search history.

(56) References Cited

U.S. PATENT DOCUMENTS 4,241,831 A * 12/1980 Locatelli ..... 206/506
2007/0194023 A1* 8/2007 Apps et al. ..... 220/6

FOREIGN PATENT DOCUMENTS

| | | |
|---|---|---|
| EP | 1 785 360 | 5/2007 |
| FR | 2 843 945 | 3/2004 |
| GB | 2 443 949 | 5/2008 |

OTHER PUBLICATIONS

Decision on Appeal for U.S. Appl. No. 11/264,371 mailed on May 11, 2009.

European Search Report for EP Application No. 09010855.6, Oct. 23, 2009.

* cited by examiner

*Primary Examiner* — Harry Grosso
(74) *Attorney, Agent, or Firm* — Carlson, Gaskey & Olds

(57) ABSTRACT

A container includes a plurality of walls extending upward from a base. At least one support is movable between a retracted position and a support position. Resilient tabs are provided to prevent inadvertent movement of the support out of the support position.

13 Claims, 9 Drawing Sheets

CONTAINER

This application claims priority to U.S. Provisional Application Ser. No. 61/091,506 filed Aug. 25, 2008.

BACKGROUND OF THE INVENTION

The present invention relates generally to containers and more particularly to a container with support members for supporting another container thereon.

Many different types of containers for transporting and storing goods are known. Some containers include retractable supports so that another container can be supported thereon. One such container includes end walls each having a support that is partially supported on the adjacent walls when in the support position. However, the support can be knocked from a support position back into the retracted position by the container being stacked thereon. This is inconvenient for the user, who has to reposition the support and re-stack the upper container more carefully.

SUMMARY OF THE INVENTION

The present invention provides a container having at least one support movable between a support position and a retracted position. At least one detent locks the support in the support position. After moving the detent from a first position to a second position, the support can be moved to the retracted position. The detent prevents inadvertent movement of the support from the support position.

In one embodiment, the detent is a tab integrally molded with the support. More than one tab can be provided.

DETAILED DESCRIPTION OF A PREFERRED EMBODIMENT

Figure 1:
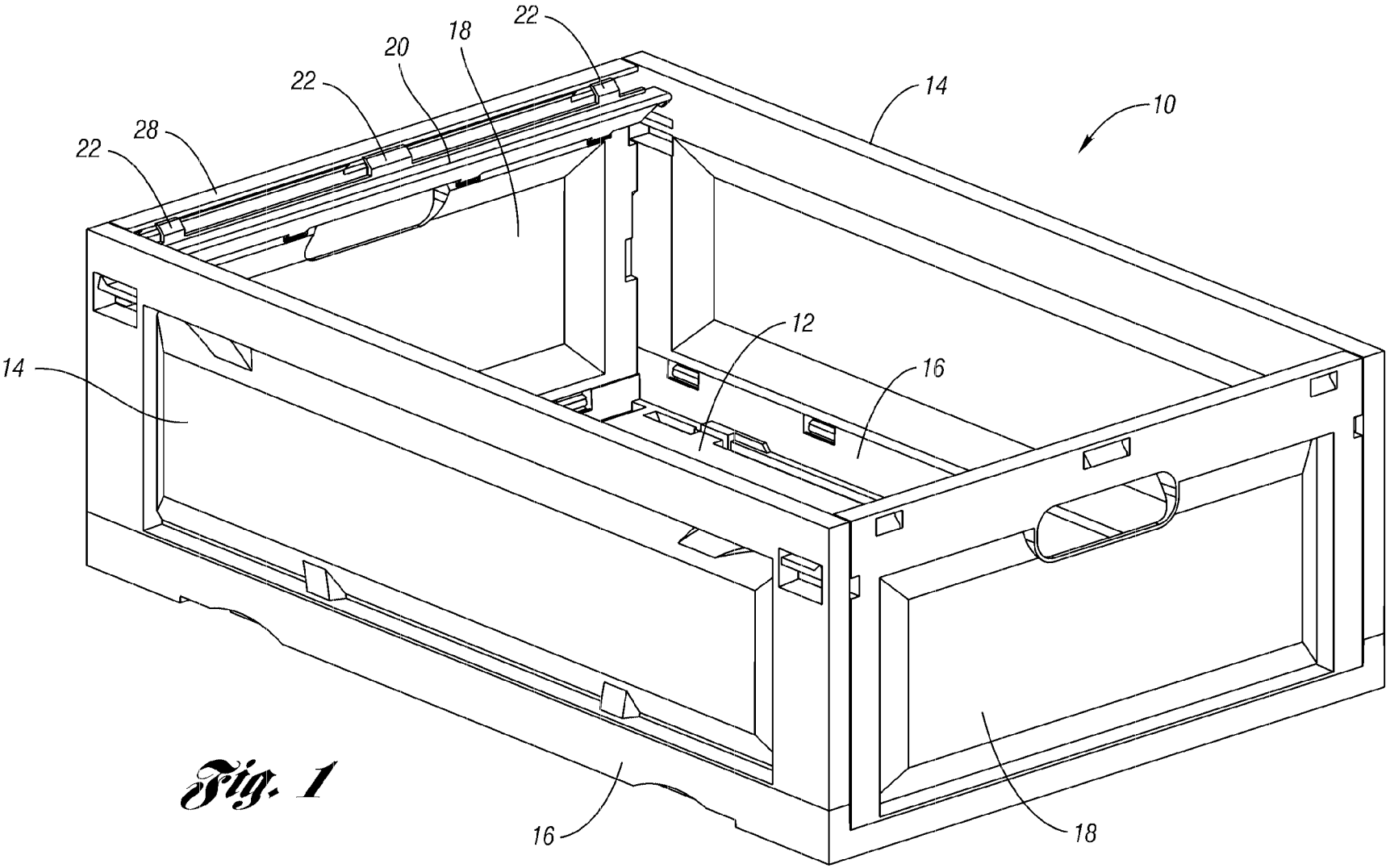
FIG. 1 is a perspective view of a container according to one embodiment of the present invention.

FIG. 1 is a perspective view of a container 10 according to one embodiment of the present invention. The container 10 includes a base 12, upstanding side walls 14 (or long walls) and upstanding end walls 18 (or short walls). In the example shown, the container 10 is collapsible. The end walls 18 are pivotably connected short edges of the base 12 and the side walls 14 are pivotably connected to upstanding flanges 16 along the side edges of the base 12. However, the invention is also applicable to containers with walls that are not collapsible.

Each end wall 18 has a support 20. Although only one support 20 is visible, the other end wall 18 is symmetric. The support 20 is pivotably mounted at its lower edge to a position spaced below an upper edge of the end wall 18. The support 20 is shown in FIG. 1 pivoted to a support position, where it projects into the interior of the container 10 where it can support another container stacked thereon. The supports 20 could each optionally include a tab (not shown) projecting from each end onto a rail (not shown) formed in an arcuate channel on an interior surface of the side walls 14 for support. The structure of the interior of the side wall 14 is not disclosed in detail in this application, but several designs are known. The end walls 18 each include a lip 28 protruding inwardly from the uppermost edge above the support 20.

Figure 2:
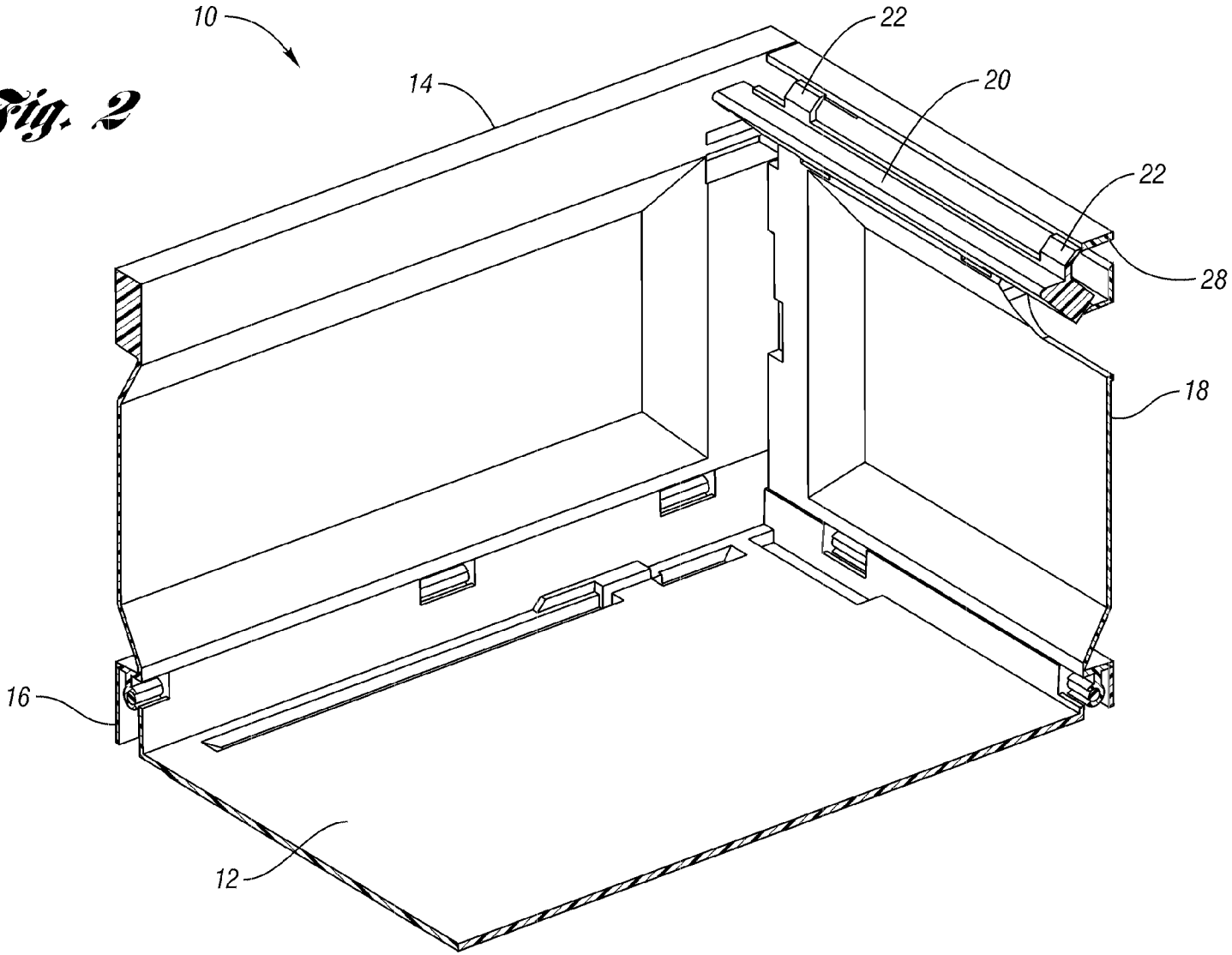
FIG. 2 shows the container of FIG. 1 in a collapsed position.
Figure 3:
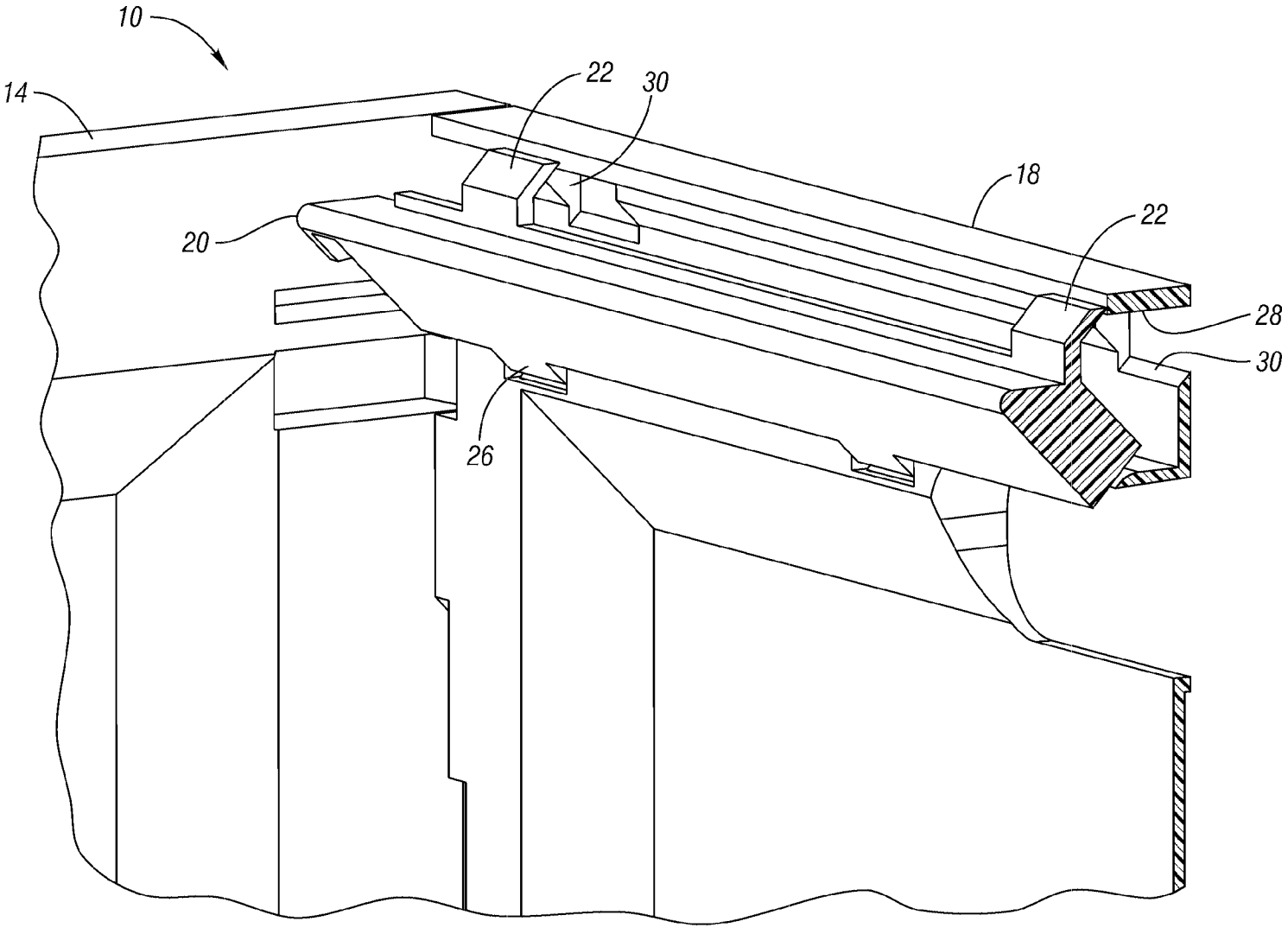
FIG. 3 is an interior perspective view of one quarter of the container.

According to the present invention, each support 20 includes at least one flexible tab 22, or "resilient stop member" or "detent," that interferes with the lip 28 (or some other fixed structure) on the end wall 18 when the support 20 is in the support position. FIG. 2 is a view of a quarter of the container 10 of FIG. 1. The other quarters would be symmetric. FIG. 3 is an enlarged view of a portion of FIG. 2.

As shown more clearly in FIG. 3, when the support 20 is in the support position, the tabs 22 contact the inner edge of the lip 28. As a result, the support 20 cannot be inadvertently knocked back into the support position. In order to return the support 20 to the support position, the tabs 22 must be deflected down under the lip 28. The tabs 22 could be shaped and configured such that they can be simply forced under the lip 28 by pushing the support 20 toward the end wall 18, or such that they must be separately deflected downward before they support 20 can be retracted, as shown.

Figure 4:
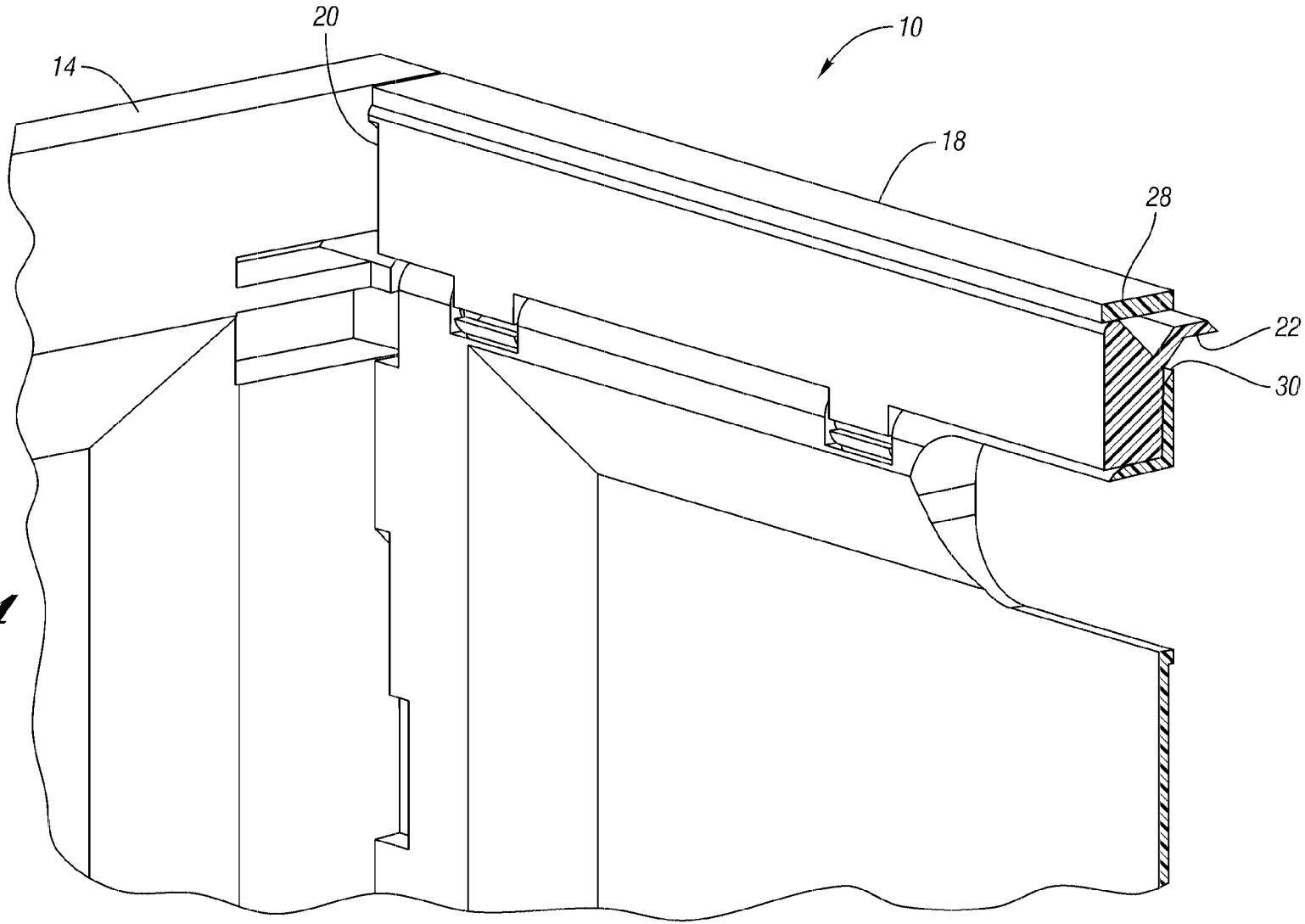
FIG. 4 is an enlarged view of a portion of FIG. 3.
Figure 5:
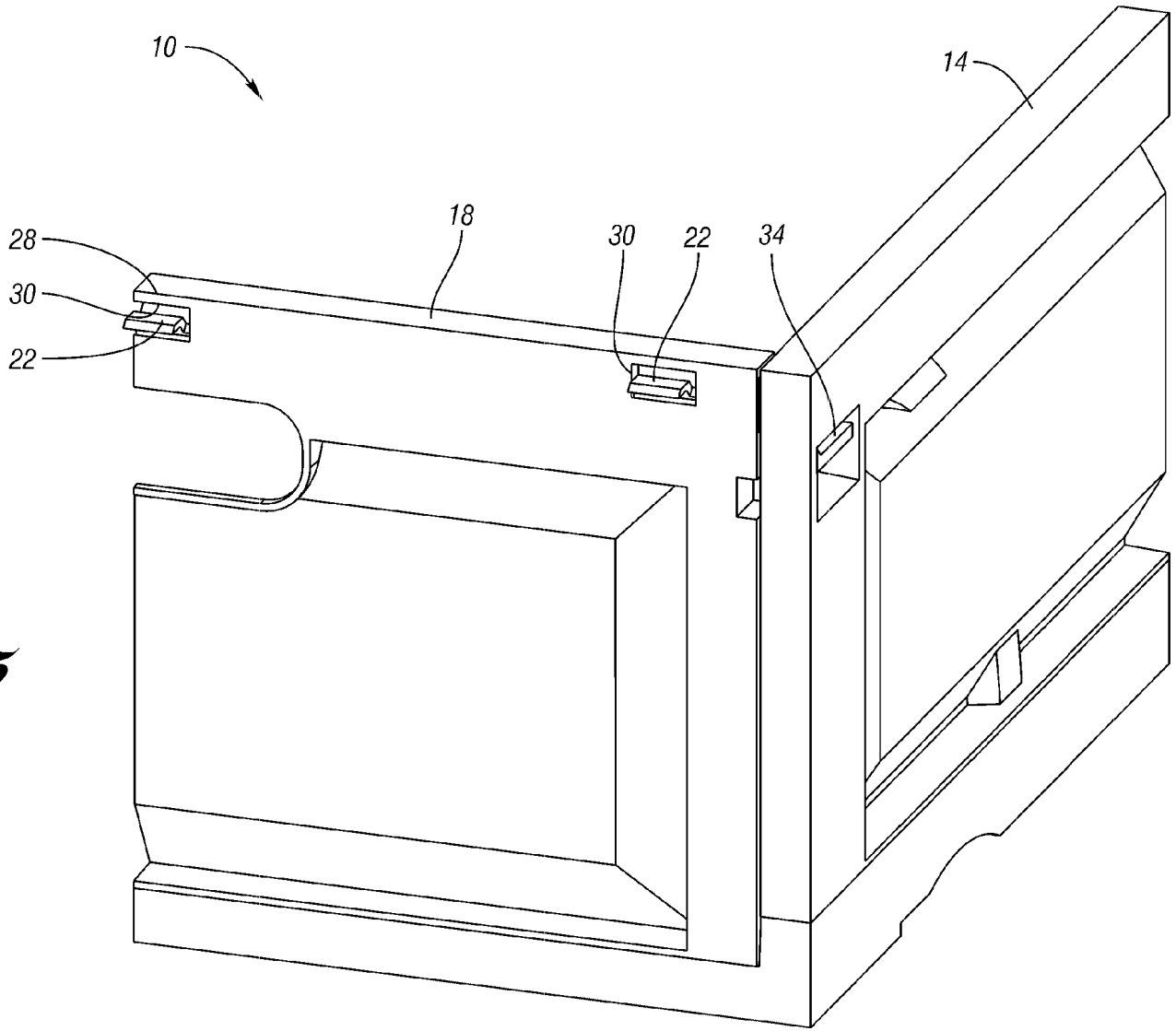
FIG. 5 is a view similar to that of FIG. 4, with the support in the retracted position.

The end wall 18 includes an opening 30 aligned with each of the tabs 22, for receiving the tabs 22 when the support 20 is moved to the retracted position, as shown in FIGS. 4 and 5. Referring to FIG. 5, the side walls 14 include latches 34 for releasably holding the end walls 18 in the upright position.

Figure 6:
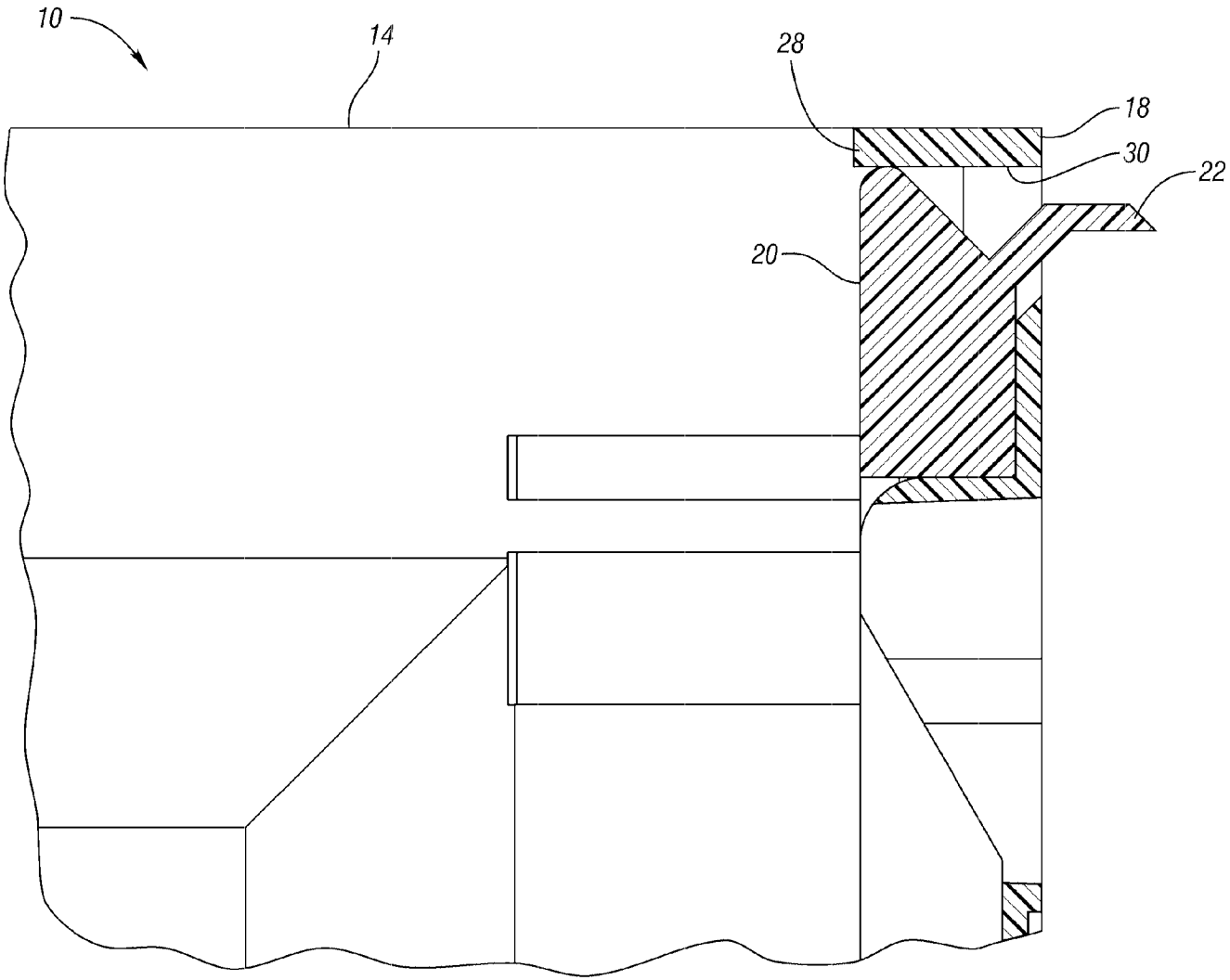
FIG. 6 is an exterior view of the corner of the container of FIG. 5.
Figure 7:
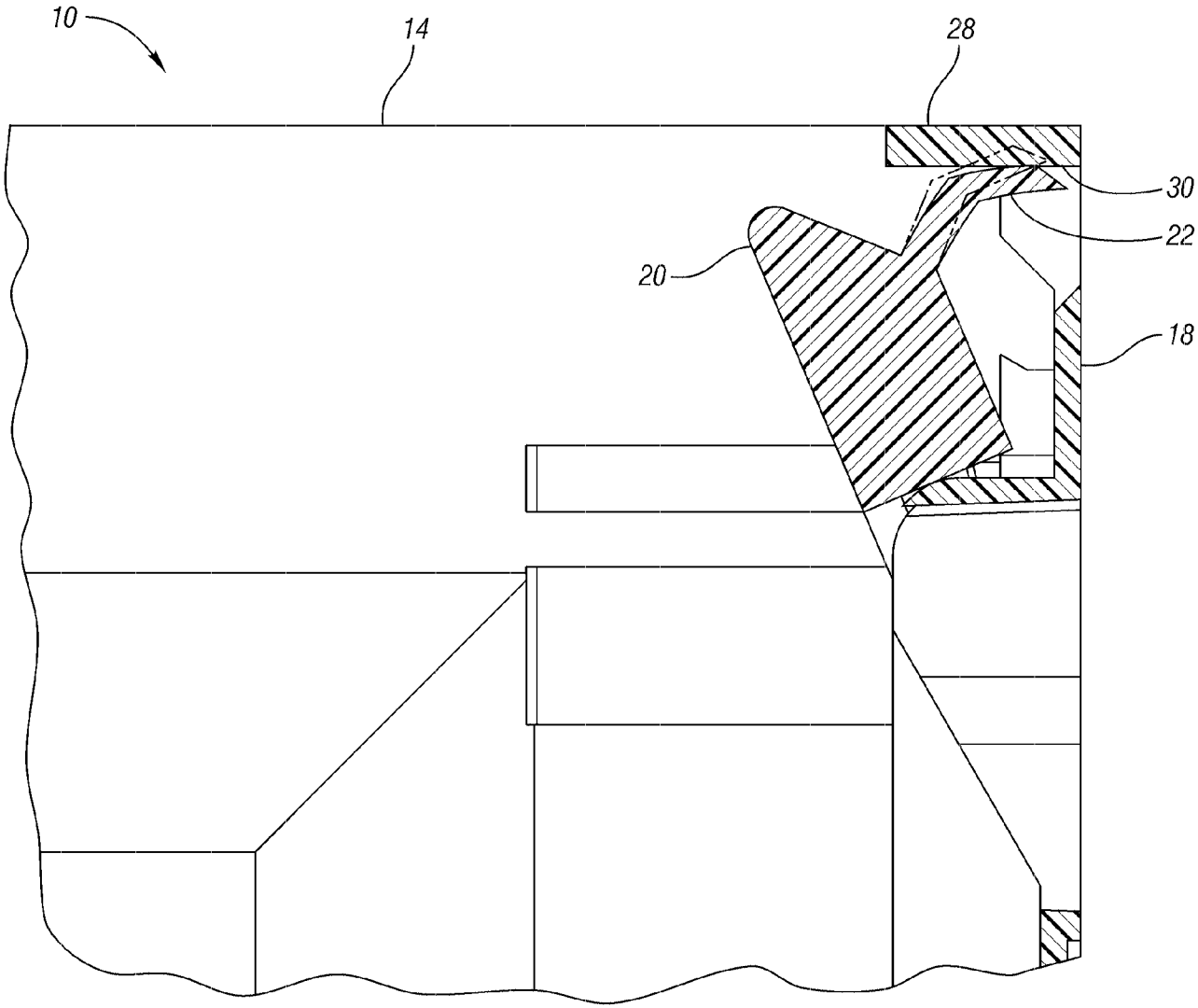
FIG. 7 is a side view of the section of the container of FIG. 5.
Figure 8:
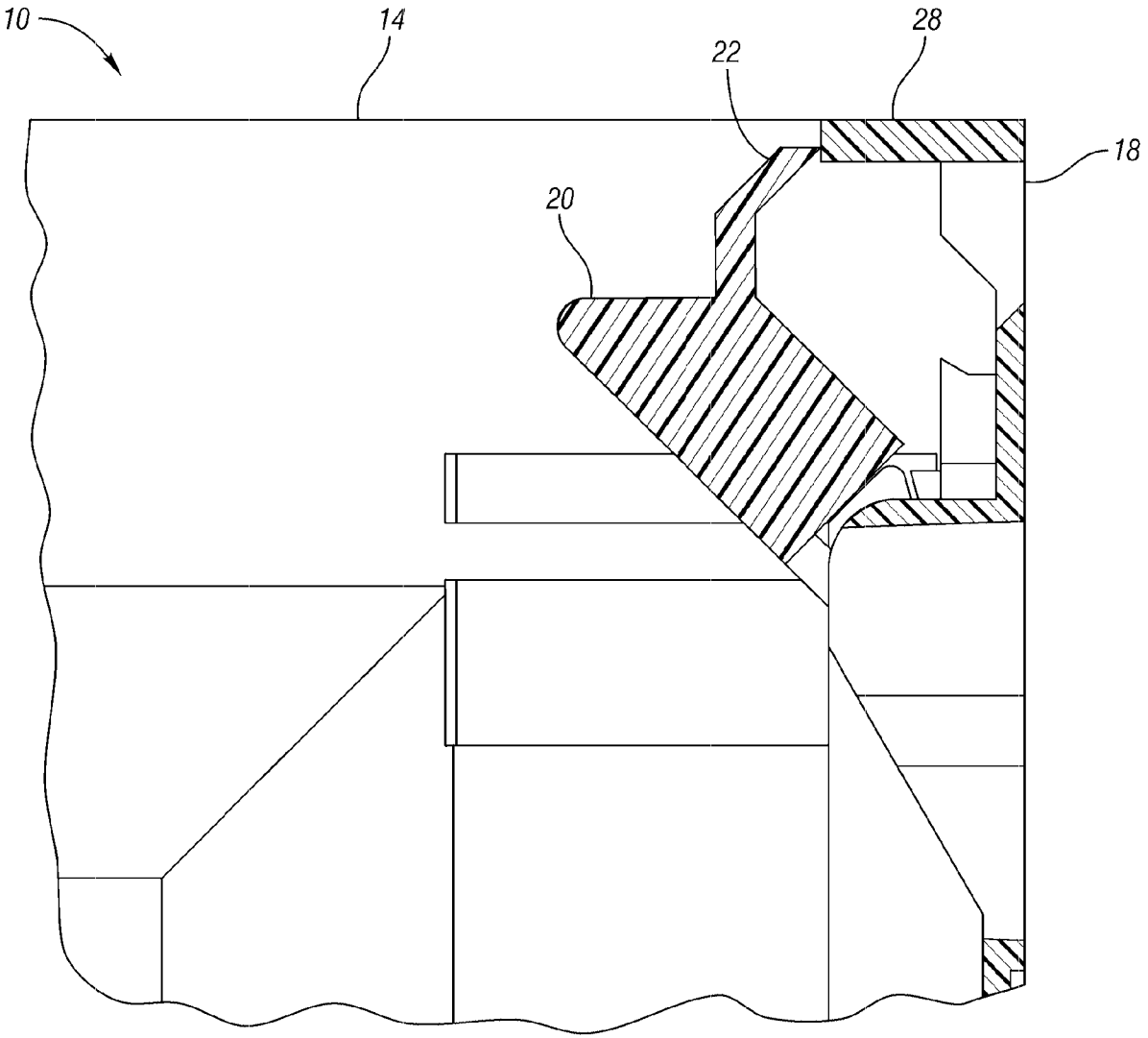
FIG. 8 is a view similar to FIG. 7 showing the support moved toward the support position.

FIGS. 6-8 are section views through the end wall 18, support 20 and one of the tabs 22. In FIG. 6, the tab 22 protrudes slightly through the opening 30 in the end wall 18 when the support 20 is in the retracted position. In FIG. 7, as the support 20 is pivoted toward the deployed position, the tab 22 contacts the lip 28 of the end wall 18 and is flexed downwardly. When the support 20 reaches the fully deployed position (or at some time before the fully deployed position), the tabs 22 return to their undeformed, original position as shown in FIG. 8. In their normal, undeformed position, the tabs 22 contact the inner edge of the lip 28 to prevent the support 20 from returning to the retracted position inadvertently. In this locked position, the support 20 can support another container thereon and will resist any inadvertent contact that might otherwise return the support 20 to the retracted position. When it is desired to return the support 20 to the retracted position, the tabs 22 can be flexed downwardly to a second position under the lip 28, and the support 20, unlocked, can be pushed back into the retracted position.

Figure 9:
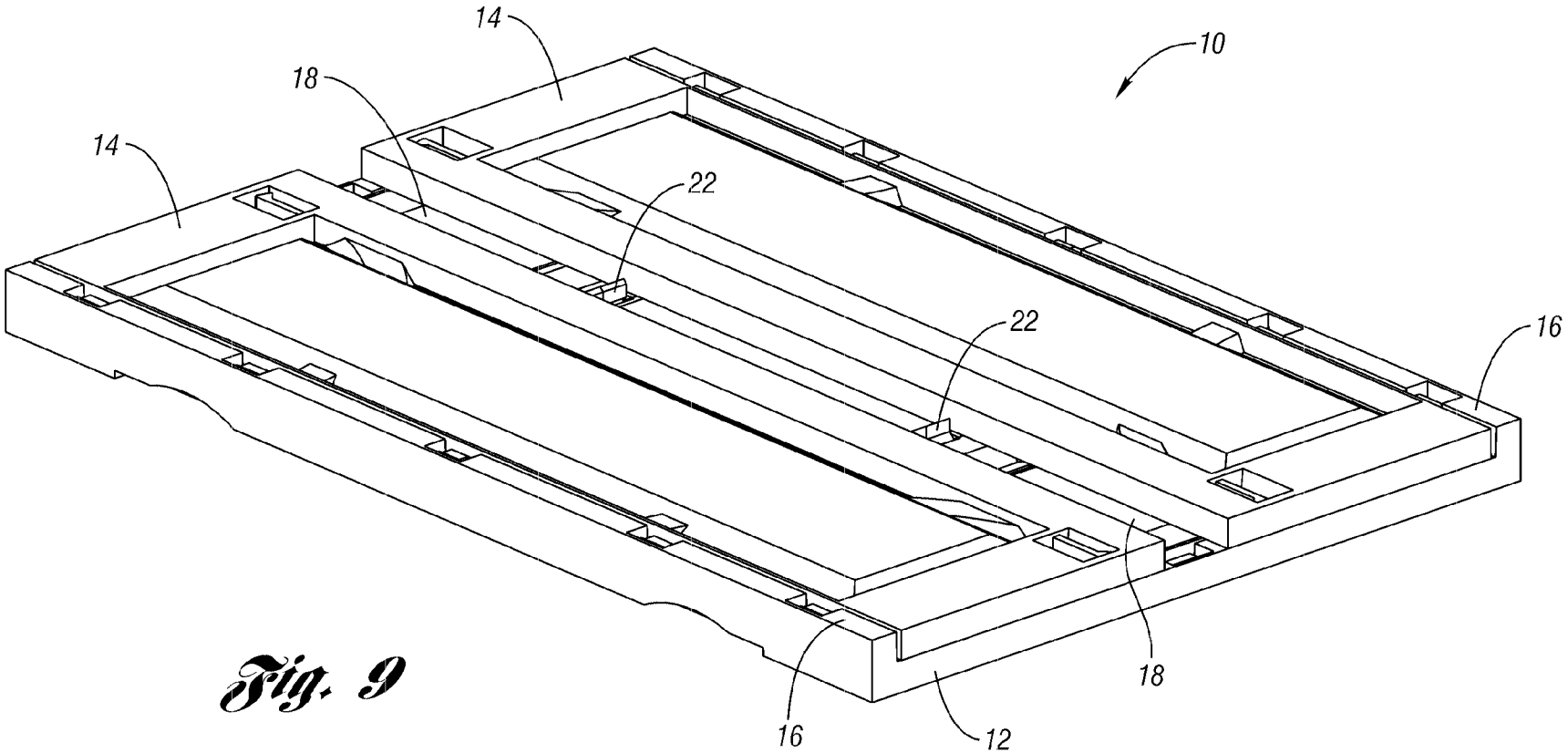
FIG. 9 is a view similar to FIG. 7 showing the support in the support position.

As shown in FIG. 9, the container 10 shown is a collapsible container 10, such that the end walls 18 can be collapsed onto the base 12 and the side walls 14 can be collapsed onto the end walls 18. However, it should be recognized that the retractable supports 20 with tabs 22 to prevent inadvertent retraction could also be provided in non-collapsible containers.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. For example, the tabs 22 could be placed in other locations on the end wall 18 and could contact structure other than the lip 28. For example, the tabs 22 could contact structure on the side wall 14. Different numbers and shapes of tabs 22 could be implemented. Further, the tabs 22 could be placed on the static structure, e.g. the lip 28 or other structure on the end wall 18 or side wall 14. The tabs 22, or any other flexible structure, should be placed to resist the return of the support 20 to the retracted position. The tabs 22 can either require manual deflection prior to permitting retraction of the support 20, or the tabs 22 can simply require more force to move the support 20 into the retracted position.

What is claimed is:

1. A container comprising:

a base;

a plurality of walls extending upward from the base, the plurality of walls including a first wall and a second wall;

a support movable relative to the first wall between a retracted position and a support position; and a stop member inhibiting movement of the support from the support position to the retracted position when the stop member is in a first position and permitting movement of the support from the support position to the retracted position when the stop member is in a second position, wherein the stop member is resiliently deformable from the first position to the second position, wherein the stop member must be separately deflected from the first position to the second position before the support can be moved to the retracted position, wherein the stop member cannot be deflected from the first position to the second position by moving the support from the support position to the retracted position.

2. The container of claim 1 wherein the stop member is integral with the support.

3. The container of claim 1 wherein the support extends further into a mouth of the container when the support is in the support position than when the support is in the retracted position.

4. The container of claim 1 wherein the support is pivotably mounted to the first wall and pivotable relative to the first wall between the support position and the retracted position.

5. The container of claim 1 wherein the stop member contacts a portion of the first wall to prevent movement of the support from the support position to the retracted position.

6. The container of claim 5 wherein the stop member protrudes through the first wall when the support is in the retracted position.

7. A container comprising:

a base;

a plurality of walls extending upward from the base, the plurality of walls including a first wall and a second wall each pivotable between an upright position and a collapsed position on the base;

a support movable relative to the first wall between a retracted position and a support position, the support extending further into a mouth of the container when the support is in the support position than when the support is in the retracted position; and at least one stop member protruding upward from the support and contacting one of the plurality of walls thereby preventing the support from moving into the retracted position while the at least one stop member is in a first position until the stop member is moved to a second position.

8. The container of claim 7 wherein the at least one stop member is integrally molded with the support.

9. The container of claim 7 wherein the at least one stop member is integral with the support.

10. The container of claim 7 wherein the at least one stop member is resiliently deformable from the first position to the second position.

11. The container of claim 7 wherein the at least one stop member contacts the first wall to prevent movement of the support from the support position to the retracted position.

12. The container of claim 7 wherein the stop member cannot be deflected from the first position to the second position by moving the support from the support position to the retracted position.

13. A method for using a container having a base, a first wall and a second wall, and a support mounted to the first wall, the method including the steps of:

a) moving the support from a retracted position toward an interior of the container to a support position;

b) locking the support in the support position; and c) unlocking the support and then moving the support into the retracted position, wherein the support must be separately unlocked before the support can be moved to the retracted position, wherein said step c) includes the step of deforming a detent to move the detent from a first position to a second position.

* * * * *